US011795718B2

(12) United States Patent
Besnier

(10) Patent No.: US 11,795,718 B2
(45) Date of Patent: Oct. 24, 2023

(54) BRUSH ASSEMBLIES PRINCIPALLY FOR AUTOMATIC SWIMMING POOL CLEANERS

(71) Applicant: ZODIAC POOL CARE EUROPE, Bron (FR)

(72) Inventor: Arnaud Besnier, Montrabe (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 618 days.

(21) Appl. No.: 16/886,274

(22) Filed: May 28, 2020

(65) Prior Publication Data

US 2020/0378143 A1 Dec. 3, 2020

Related U.S. Application Data

(60) Provisional application No. 62/853,963, filed on May 29, 2019.

(51) Int. Cl.

| | |
|---|---|
| ***E04H 4/16*** | (2006.01) |
| ***A46B 9/00*** | (2006.01) |
| *A46B 13/02* | (2006.01) |

(52) U.S. Cl.

CPC ..... *E04H 4/1654* (2013.01); *A46B 9/005* (2013.01); *A46B 13/02* (2013.01); *A46B 2200/3073* (2013.01)

(58) Field of Classification Search

CPC ..... B60S 3/06; E04H 4/16; A46B 13/02

See application file for complete search history.

(56) References Cited

U.S. PATENT DOCUMENTS

| | | | | |
|---|---|---|---|---|
| 6,564,417 | B2 † | 5/2003 | Porat | |
| 8,065,771 | B2 † | 11/2011 | Hui | |
| 9,388,595 | B2 † | 7/2016 | Durvasula | |
| 9,758,978 | B2 | 9/2017 | Shlomi-Shlomi et al. | |
| 9,945,140 | B2 † | 4/2018 | LaCalle Bayo et al. | |
| 10,156,083 | B2 † | 12/2018 | Ortiz | |
| 2002/0083541 | A1 | 7/2002 | Porat | |
| 2008/0244843 | A1 * | 10/2008 | Hui | E04H 4/1654 15/1.7 |

(Continued)

FOREIGN PATENT DOCUMENTS

| | | |
|---|---|---|
| EP | 1978184 | 10/2008 |
| EP | 3388599 A1 | 10/2018 |

(Continued)

OTHER PUBLICATIONS

International Application No. PCT/162020/055094, International Preliminary Report on Patentability dated Dec. 9, 2021, 7 pp.

(Continued)

*Primary Examiner* — Michael D Jennings

(74) *Attorney, Agent, or Firm* — Kilpatrick Townsend & Stockton LLP

(57) ABSTRACT

Brushes for robotic or other automatic swimming pool cleaners may include circumferentially-spaced blades extending radially from cylindrical cores. The blades beneficially are not longitudinally continuous, however. Instead, some or all of the blades are discontinuous along the lengths of the cores, creating fluid-flow paths tending to reduce the pump blade effect when the cleaners are operating.

4 Claims, 4 Drawing Sheets

(56) References Cited

U.S. PATENT DOCUMENTS

| | | | | |
|---|---|---|---|---|
| 2009/0241989 | A1* | 10/2009 | MacNeil | A46B 13/008 15/53.4 |
| 2009/0250993 | A1* | 10/2009 | Vivyan | A46B 13/003 15/53.1 |
| 2014/0366297 | A1* | 12/2014 | Shlomi-Shlomi | E04H 4/16 15/160 |
| 2018/0009419 | A1* | 1/2018 | Favagrossa | A46B 9/025 |
| 2018/0328062 | A1 | 11/2018 | Ortiz et al. | |

FOREIGN PATENT DOCUMENTS

| | | | |
|---|---|---|---|
| EP | 3333343 | B1 | 7/2019 |
| FR | 2993298 | | 1/2014 |
| WO | 2015181406 | | 12/2015 |
| WO | 2016201404 | | 12/2016 |

OTHER PUBLICATIONS

PCT Application No. PCT/IB2020/055094, International Search Report and Written Opinion dated Aug. 26, 2020, 12 pages.
European Application No. 20730746.3, Office Action dated Jan. 27, 2023, 4 pages.

* cited by examiner
† cited by third party

BRUSH ASSEMBLIES PRINCIPALLY FOR AUTOMATIC SWIMMING POOL CLEANERS

CROSS-REFERENCE TO RELATED APPLICATION

This application claims the benefit of and priority to U.S. Provisional Patent Application Ser. No. 62/853,963, filed May 29, 2019, the entire contents of which are hereby incorporated herein by this reference.

FIELD OF THE INVENTION

This invention relates to cleaning devices for swimming pools and spas and more particularly, although not necessarily exclusively, to autonomous vehicles configured to facilitate filtering of debris from water of pools and spas.

BACKGROUND OF THE INVENTION

Automatic swimming pool cleaners (APCs) conventionally include various features designed to improve their cleaning performance. At least some robotic APCs, for example, are constructed with brushes adjacent the fronts and rears of the bodies of the devices. The brushes frequently are formed with elongated cylindrical cores whose longitudinal axes are oriented transverse to the normal forward direction of travel of their associated APC and which are configured to rotate about the longitudinal axes to help draw debris into suspension in water for collection by a fluid inlet of the APC.

Some brushes further may include circumferentially-spaced wipers, or blades, which extend radially from the cylindrical cores along their lengths. These blades, when present, typically are (longitudinally) continuous along the lengths of the cores and are identically shaped and sized. At times, however, these brushes are subject to a "pump blade" effect that continuously pushes debris in front of the cleaner rather than toward the fluid inlet.

U.S. Pat. No. 9,758,978 to Shlomi-Shlomi, et al., describes different cleaning brushes for use as components of robotic APCs. At least one such brush includes a cylindrical central portion in the form of an elongated tube. The brush additionally comprises left- and right-handed helical fins and first and second protuberances. According to the Shlomi-Shlomi patent, the left-handed fins have a positive slope relative to a longitudinal axis of the central portion, whereas the right-handed fins have a negative slope relative to that axis. Further stated in the Shlomi-Shlomi patent is that these fins may "be replaced by spaced apart ring shaped fins that surround the central portion" of the brush. In either circumstance, however, the fins are oriented predominantly circumferentially about the central portion.

In at least some versions of the brush of the Shlomi-Shlomi patent, the first and second protuberances are "identical to each other." The protuberances may be "arrange[d] in rows that are parallel to the longitudinal axis" of the central portion. They also may extend radially from the central portion. Accordingly, the protuberances are bounded by the fins (as shown in, e.g., FIG. 1 of the Shlomi-Shlomi patent) and thus impede fluid flow between adjacent fins.

Detailed in the Shlomi-Shlomi patent is that such a brush "trims algae and converges . . . loose dirt efficiently toward the suction inlet" of the robotic APC. This occurs as parallel brushes of the APC rotate about their longitudinal axes. Such rotation of one brush may occur in synchronicity with or independently of another.

SUMMARY OF THE INVENTION

The present invention provides alternatives to conventional brushes, including those of the Shlomi-Shlomi patent. At least one version employs circumferentially-spaced blades extending radially from cylindrical cores. Rather than all being longitudinally continuous, however, most or all of the blades are discontinuous along the length of a core. Discontinuous regions of blades may be staggered longitudinally, moreover, creating fluid-flow paths tending to counteract the pump blade effect.

Fluid-flow paths of the invention preferably have at least some circumferential component, so pool water may flow about most, if not all, of the circumference of the core of a brush. Such paths advantageously are not circular, however. Indeed, for some embodiments the paths beneficially assume a zig-zag shape because of the staggered discontinuities. Serpentine fluid-flow paths may be formed alternatively or additionally, as may other non-linear or linear shapes.

Brushes of the invention may attach to APCs in any desired manner. Typically, they are driven directly or indirectly by a motor of an APC and rotate about longitudinal brush axes that are transverse to the direction of movement of the APC. Further, they often are (but need not be) positioned so as to form leading and trailing edges of bodies of APCs, as shown in the Shlomi-Shlomi patent.

It thus is an optional, non-exclusive object of the present invention to provide brushes for robotic or other APCs.

It is an additional optional, non-exclusive object of the present invention to provide APCs with brushes facilitating the pushing of debris toward cleaner inlets rather than away therefrom.

It is a further optional, non-exclusive object of the present invention to provide brushes in which fluid-flow paths with at least some circumferential component are formed.

It is, moreover, an optional, non-exclusive object of the present invention to provide circumferentially non-linear fluid-flow paths on brushes.

Other objects, features, and advantages of the present invention will be apparent to those skilled in the relevant art with reference to the remaining text and the drawings of this application.

DETAILED DESCRIPTION

Figure 4:
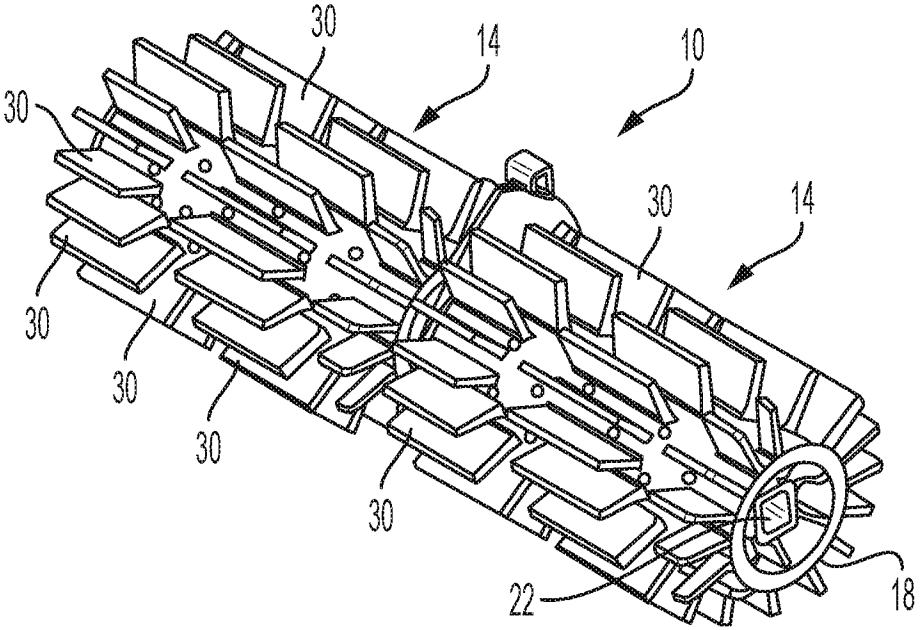
FIG. 4 is a brush assembly of the present invention shown as wrapped about an interface for use as part of an APC.

Brush assembly 10 of FIG. 4 may include one or more brushes 14. Each brush 14 may be wrapped about a tube, shaft, or other appropriate component such as interface 18. Interface 18, in turn, is configured to rotate, driven directly or indirectly by a motor of an APC. As shown in FIG. 4, interface 18 may include a recess 22 to frictionally receive a rotating shaft connected directly or indirectly to the motor. Brush assembly 10 additionally may include any components suitable to connect to a body of the APC for use.

As interface 18 rotates, so too do the brushes 14 wrapped about (or otherwise attached to) the interface 18. Such rotation may be clockwise or counter-clockwise as appropriate or desired. Rotation of brushes 14 as an associated APC travels along an immersed pool surface tends to disturb debris present on or near the surface. A rationale for disturbing the debris is to suspend it in water being ingested through an inlet of the APC in order to pass the debris-laden water through a filter which retains at least some of the debris.

Often, however, rotation of conventional brushes results in substantial debris being pushed away from the inlet rather than being directed toward it. One significant reason for this result is that blades of the brushes are longitudinally continuous (or substantially so), hence preventing establishment of circumferential water-flow paths around the cores of the brushes. This "pump blade" effect reduces cleaning efficiency of the APCs.

Brushes 14 of the invention may be formed of plastic or other flexible material and beneficially possess sufficient flexibility to wrap about interface 18 and frictionally contact pool surfaces without damaging them. A brush 14 may comprise core or base 26 and blades 30. Blades 30 preferably protrude outward from base 26 and are integrally molded therewith, although they may attach to base 26 in other manners if desired.

Figure 1:
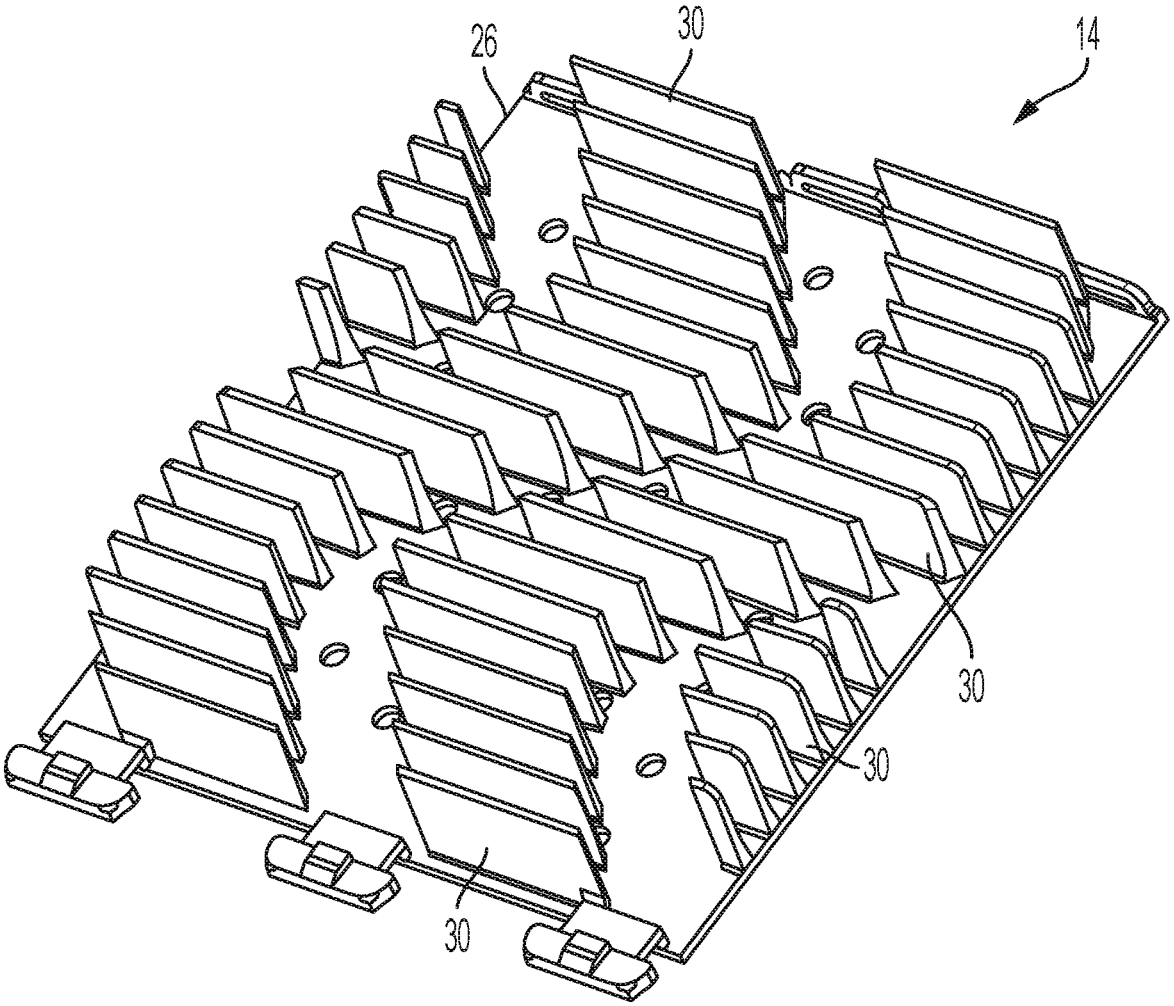
FIGS. 1-2 are perspective views of portions of brush assemblies of the present invention prior to being wrapped about interfaces for use as parts of APCs.
Figure 2:
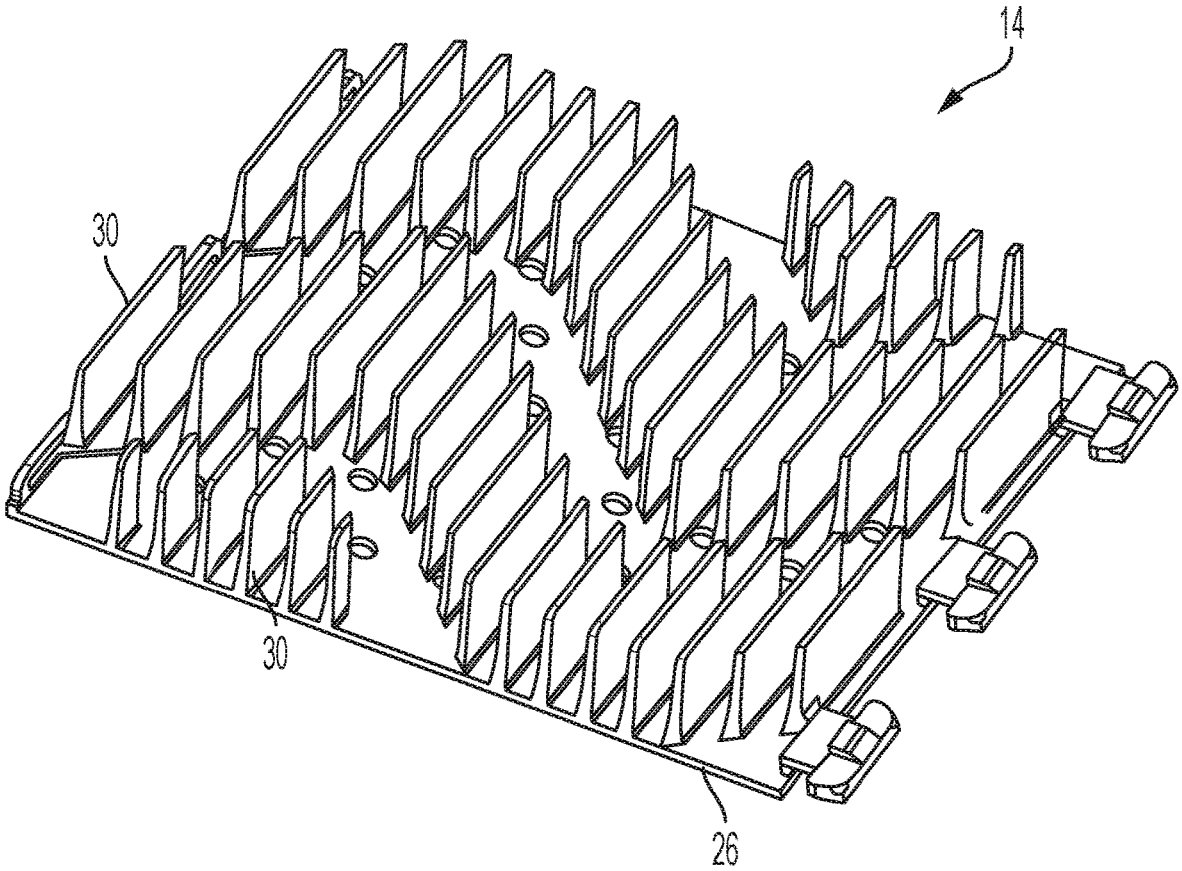
Figure 3:
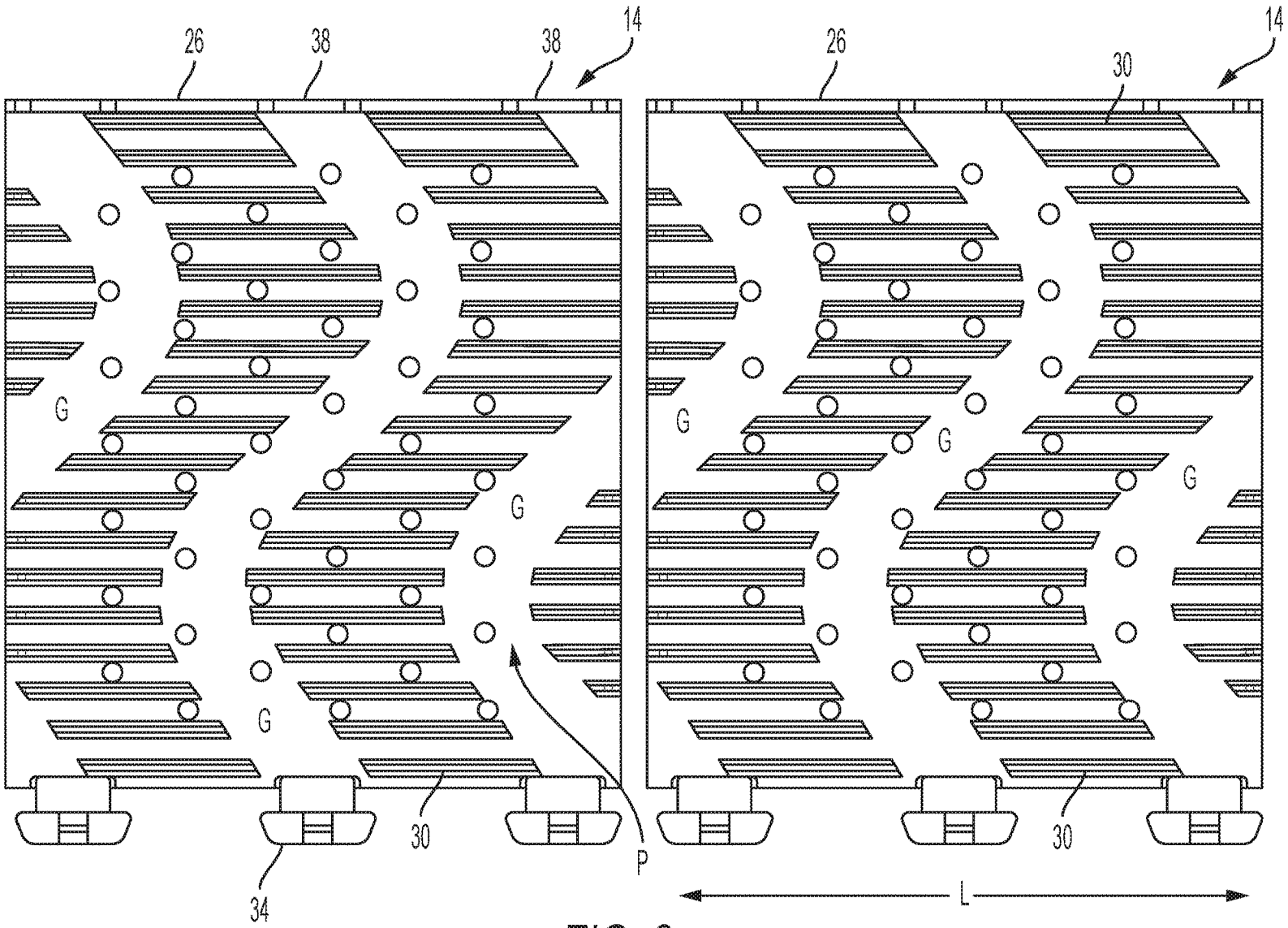
FIG. 3 is a plan view of two such portions of FIG. 1 arranged side-by-side.

Brush 14 additionally may include connectors to facilitate their interaction with interface 18. For example, FIGS. 1-3 illustrate prongs 34 and recesses 38. When brushes 14 are wrapped about interface 18 as shown in FIG. 4, prongs 34 may be received by corresponding recesses 38 to secure each brush 14 about interface 18. Persons skilled in the art will recognize that numerous other means of securing a brush 14 to interface 18 may be employed instead, however.

When a brush 14 is wrapped about (or otherwise attached to) interface 18, base 26 becomes generally cylindrical as depicted in FIG. 4. In such event blades 30 may be described as being parallel to one another and spaced about the perimeter, or circumference, of the base 26. And if base 26 is ascribed a length L (see FIG. 3), blades 30 may be described as extending generally longitudinally along the length L. Blades 30 need not necessarily be shaped, positioned, or oriented as illustrated in FIGS. 1-4, however.

Advantageously, blades 30 are not continuous along length L. Instead, gaps G exist about the circumference of base 26 where no blade 30 is present. At least some of these gaps G beneficially extend around the entire circumference of base 26 to form fluid-flow paths P, through which debris-laden water may flow along base 26 unimpeded by blades 30. Alternatively, some gaps G may extend around at least a majority of the circumference of base 26.

Moreover, discontinuities of circumferentially-adjacent blades 30 may be staggered longitudinally (as well shown in FIG. 3). Gaps G hence may form flow paths P that are non-linear; e.g., serpentine or zig-zag in shape. Although shapes such as these are presently preferred, paths P alternatively may have different non-linear (or linear) shapes instead. In any event, the fluid-flow paths P tend to counteract the "pump blade" effect as brushes 14 rotate, reducing the amount of debris pushed away from APC inlets and improving cleaning efficiency.

Exemplary concepts or combinations of features of the invention may include:

A. A brush comprising generally longitudinally-oriented blades that are discontinuous along a length of the brush.

B. A brush comprising circumferentially-spaced, generally longitudinally-oriented blades having discontinuities positioned so as to form at least one fluid-flow path along at least a majority of a circumference of the brush.

C. A brush assembly comprising a brush consistent with statement "A" or "B" as well as an interface for connecting the brush to an APC.

D. An APC comprising the brush assembly of statement "C."

E. A brush consistent with statement "B" in which the at least one fluid-flow path is non-linear.

F. A brush consistent with statement "E" in which the at least one fluid-flow path is serpentine or zig-zag shaped.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The entire contents of the Shlomi-Shlomi patent are incorporated herein by this reference. Further, although applicant has described filters for use with APCs, persons skilled in the relevant field will recognize that the present invention may be employed in other devices such as (but not limited to) manual pool cleaners. Finally, references to "pools" and "swimming pools" herein may also refer to spas or other water containing vessels used for recreation or therapy and for which cleaning is needed or desired.

What is claimed is:

1. A pool cleaning brush having a length and circumference in use, the pool cleaning brush comprising a plurality of generally longitudinally-oriented blades that are discontinuous along the length, wherein adjacent blades of the generally longitudinally-oriented blades are spaced about the circumference, and wherein discontinuities of the plurality of generally longitudinally-oriented blades form at least one unimpeded, non-linear fluid flow path along at least a majority of the circumference.

2. A pool cleaning brush according to claim 1 in which the at least one fluid flow path is serpentine or zig-zag shaped.

3. A brush assembly comprising:

a. the pool cleaning brush according to claim 1; and b. an interface configured to connect the brush to an automatic swimming pool cleaner.

4. An automatic swimming pool cleaner comprising the brush according to claim 1.

* * * * *